US009725934B2

(12) United States Patent
Vetter

(10) Patent No.: US 9,725,934 B2
(45) Date of Patent: Aug. 8, 2017

(54) LOW PROFILE LOCK FOR WINDOWS

(71) Applicant: Truth Hardware Corporation, Owatonna, MN (US)

(72) Inventor: Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 14/475,151

(22) Filed: Sep. 2, 2014

(65) Prior Publication Data

US 2016/0060919 A1 Mar. 3, 2016

(51) Int. Cl.

| | |
|---|---|
| ***E05B 3/00*** | (2006.01) |
| ***E05C 9/02*** | (2006.01) |
| ***E05B 63/00*** | (2006.01) |
| ***E05C 9/18*** | (2006.01) |
| ***E05B 1/00*** | (2006.01) |

(52) U.S. Cl.

CPC ..... *E05C 9/025* (2013.01); *E05B 1/0092* (2013.01); *E05B 63/0052* (2013.01); *E05C 9/185* (2013.01)

(58) Field of Classification Search

CPC ..... E05Y 2201/244; E05C 9/021; E05C 1/06; E05C 9/16; E05C 17/24; E05C 3/08; E05F 11/16; E05F 11/34; E05F 11/24; E05F 15/63; E05F 11/06; E05F 11/10; Y10S 292/20; Y10S 292/47; E05B 7/00

USPC ..... 292/336.3, DIG. 7, DIG. 20, DIG. 33, 292/DIG. 49

See application file for complete search history.

(56) References Cited

U.S. PATENT DOCUMENTS

| | | | | |
|---|---|---|---|---|
| 4,991,886 | A * | 2/1991 | Nolte | E05C 9/025 292/161 |
| 5,815,984 | A * | 10/1998 | Sheets | E05F 11/34 49/246 |
| 5,829,802 | A * | 11/1998 | Anderson | E05B 7/00 292/139 |
| 5,927,768 | A * | 7/1999 | Dallmann | E05C 9/02 292/139 |
| 6,431,620 | B2 * | 8/2002 | Tremblay | 292/263 |
| 6,450,554 | B1 * | 9/2002 | Rotondi | E05C 9/02 292/139 |
| 6,837,004 | B2 * | 1/2005 | Annes | E05C 9/1808 292/DIG. 20 |
| 7,581,768 | B2 * | 9/2009 | Balbo Di Vinadio | E05D 15/526 16/382 |
| 9,109,384 | B2 * | 8/2015 | Minter | E05C 19/10 |
| 2001/0019211 | A1 * | 9/2001 | Tremblay | E05C 9/185 292/70 |

(Continued)

*Primary Examiner* — Mark Williams

(74) *Attorney, Agent, or Firm* — Patterson Thuente Pedersen P.A.

(57) ABSTRACT

A lock for a window which includes a body including a channel defined in an interior of the body, an actuator element configured to be received in the channel and slidable therein, the actuator element including a fork portion to operably couple with a tie bar assembly for locking the window, a handle pivotally coupled to the actuator element, and a linkage pivotally coupled between the body and an intermediate point on the handle. The handle is movable between a closed position and an open position, with movement of the handle causing the actuator element to slide within the channel in a direction opposite the direction of movement of the handle.

5 Claims, 10 Drawing Sheets

(56) References Cited

U.S. PATENT DOCUMENTS

2008/0250719 A1* 10/2008 Griffin ..... E05C 9/02
49/339
2014/0070547 A1* 3/2014 Minter ..... E05C 19/10
292/101

* cited by examiner

LOW PROFILE LOCK FOR WINDOWS

FIELD OF THE INVENTION

The present invention relates generally to casement and awning windows, and more specifically to locking devices for casement and awning windows.

BACKGROUND OF THE INVENTION

A casement or an awning window generally refers to a sash that is attached to its frame by one or more hinges. The hinges can be located on any side of the sash and the frame though generally not on the lower edge of the sash and frame. In general, a casement window rotates along a horizontal plane (the hinges of a casement window defining a vertical rotation axis), while an awning window rotates along a vertical plane (the hinges of an awning window defining a horizontal rotation axis). Most casement and awning windows which employ the use of a crank lever or cam handle operator open outwardly so as not to interfere with the operator of the window.

Conventionally, windows, such as casement or awning windows, are locked by manipulation of a lock actuator handle which causes corresponding motion in a catch. The actuator is affixed to a window frame so that the catch engages a keeper on a corresponding section of a movable window sash to securely hold the sash against the frame. Where only one keeper on the sash is engaged by a catch, the locking mechanism is referred to as a "single-point" locking mechanism.

Also known in the art are "multi-point" locking mechanisms. Multi-point sash lock systems for casement windows generally typically have a single operating control, usually a lever. The lever is typically linked to a tie-bar that has multiple engaging structures disposed at intervals along its length. Operation of the lever causes the tie-bar to translate or move. Keepers are attached to the window sash proximate the locations of each of the engaging structures so that as the tie-bar moves, the engaging structures are moved in and out of engagement with the keepers. The entire sash lock assembly is usually concealed in the frame construction of the window, with the exception of the lever, which projects from a slot on the interior side of the window.

What is still needed is a low profile window lock for casement and awning windows.

SUMMARY OF THE INVENTION

In one embodiment, the present invention comprises a lock for a window which includes a body including a channel defined in an interior of the body, an actuator element configured to be received in the channel and slidable therein, the actuator element including a fork portion to operably couple with a tie bar assembly for locking the window, a handle pivotally coupled to the actuator element, and a linkage pivotally coupled between the body and an intermediate point on the handle. The handle is movable between a closed position and an open position, with movement of the handle causing the actuator element to slide within the channel in a direction opposite the direction of movement of the handle.

In one embodiment, the present invention comprises a system including a lock and a tie bar assembly. The lock comprises an elongated body portion having a length greater than a width, a fork component in slidable communication with the elongated body portion, a linkage pivotally coupled to the body portion, and a handle pivotally coupled at one end to the fork component and pivotally coupled at an intermediate point on the handle to the linkage. The tie bar assembly includes at least one roller for engaging a keeper of a window sash. The fork component of the lock is operably engaged with the tie bar assembly such that movement of the handle causes a sliding movement of the fork component along a portion of the length of the body portion in a direction opposite the direction of movement of the handle so as to engage or disengage the at least one roller from the keeper.

BRIEF DESCRIPTION OF THE DRAWINGS

The invention may be more completely understood in consideration of the following detailed description of various embodiments of the invention in connection with the accompanying drawings, in which.

Figure 1:
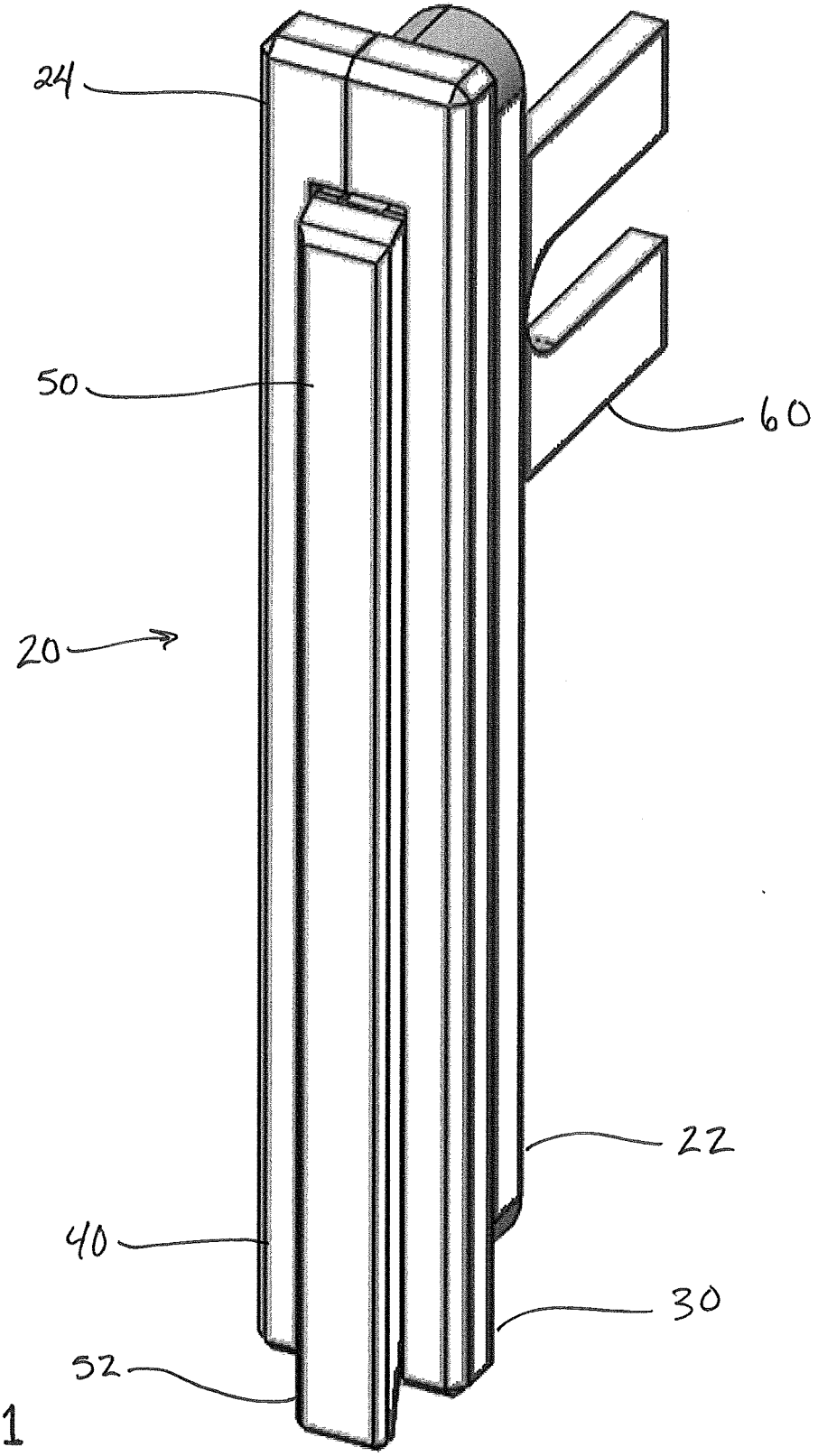
FIG. 1 is a perspective view of a low profile window lock in a closed, locked position, according to an embodiment of the invention.
Figure 2:
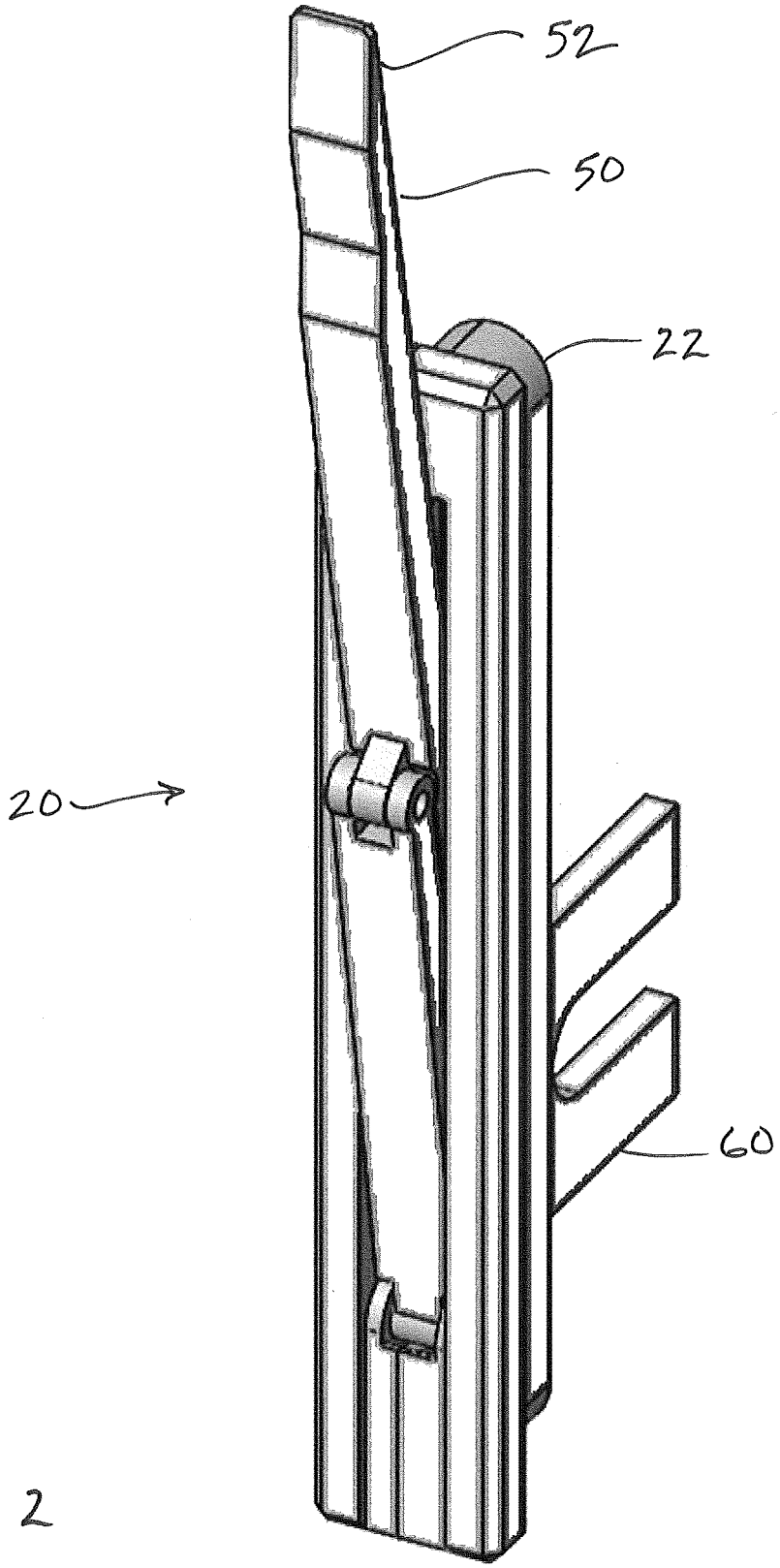
FIG. 2 is a perspective view of the low profile window lock of FIG. 1, in an open, unlocked position.
Figure 3:
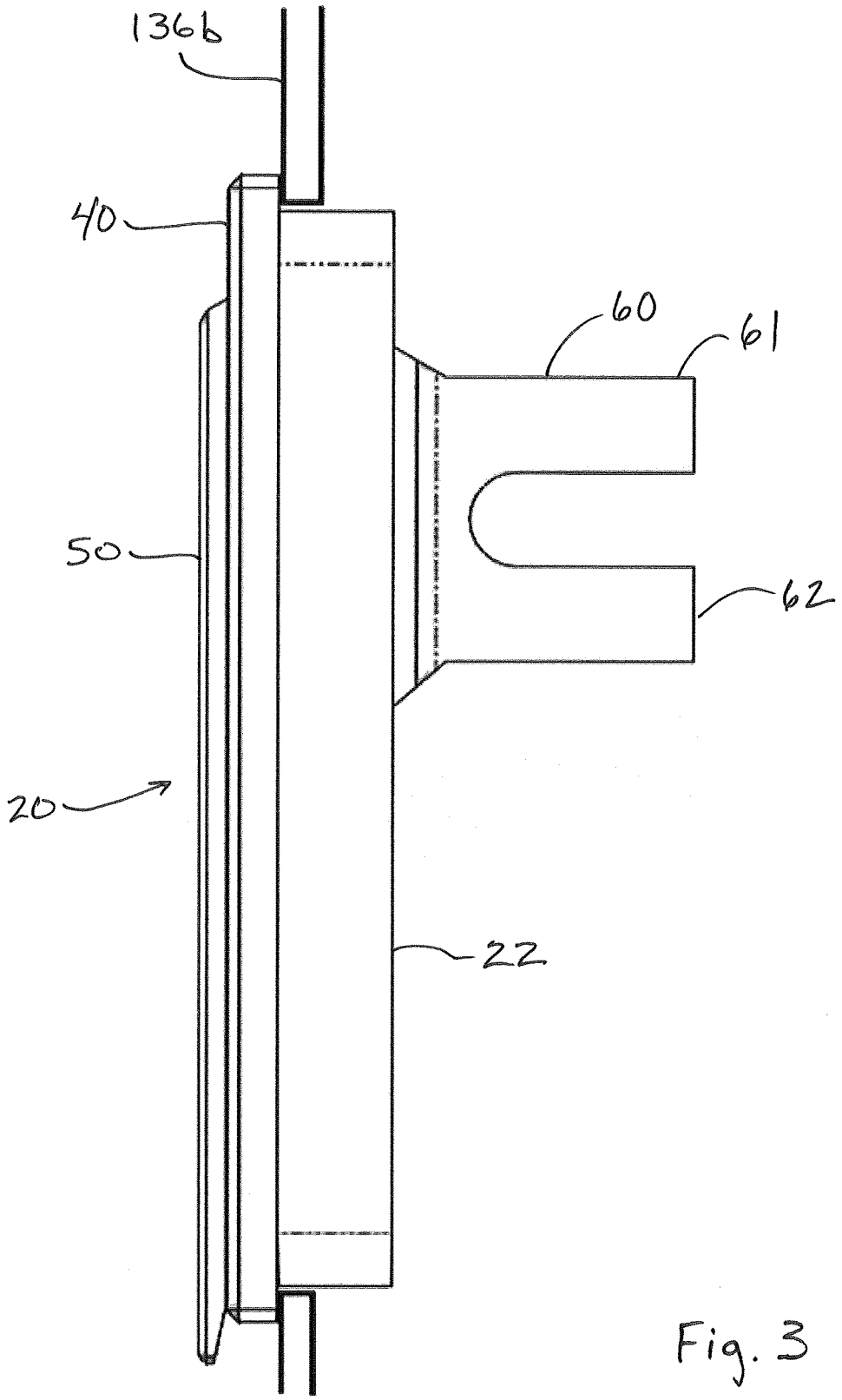
FIG. 3 is a right elevation of the low profile lock of FIG. 1 installed in a window frame.

While the invention is amendable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

The following detailed description should be read with reference to the drawings in which similar elements in different drawings are numbered the same. The drawings, which are not necessarily to scale, depict illustrative embodiments and are not intended to limit the scope of the invention.

For general information pertaining to casement and awning windows, as well as components of locking mechanisms that may be used in whole or in part with embodiments of the present invention, reference is made to the following commonly assigned patents: U.S. Pat. No. 5,087,087 to Vetter et al., U.S. Pat. No. 5,118,145 to Tucker, U.S. Pat. No. 5,813,710 to Anderson, U.S. Pat. No. 5,829,802 to Anderson et al., U.S. Pat. No. 5,839,767 to Piltingsrud, U.S. Pat. No. 5,927,768 to Dallmann et al., U.S. Pat. No. 6,450,554 to Rotondi et al., and U.S. Pat. No. 7,452,014 to Vetter, the disclosures of which are hereby incorporated by reference in their entireties.

Referring generally to FIGS. 1-7, low profile lock 20 generally includes a body portion 22, a handle 50, an actuator fork 60 and a linkage 70. Body (or casing) portion 22 comprises a first (left) case half 24 and a second (right) case half 30, wherein left case half 24 includes a recess 26 and a channel 28 provided on an inner surface of case half 24, and wherein right case half 30 includes a recess 32, a channel 34 provided on an inner surface of case half 30, and a protrusion 36. One or more assembly bores 38 are provided for allowing left case half 24 and right case half 30 to be releasably coupled to one another via suitable fasteners (not pictured). In one embodiment, each of left case half 24 and right case half 30 includes an escutcheon portion 40 which provides an aesthetically pleasing, finished look to lock 20. In an alternate embodiment not depicted, a separate unitary escutcheon is provided which is coupleable to body portion 22 after assembly of left case half 24 to right case half 30.

Handle or lever 50 includes a grip portion 50 which extends the reach of handle 50 and allows easier grasping of handle 50, and a tab 54 and an inner pivot point 56 for coupling handle 50 to fork 60 and linkage 70. Lock 20 is configured such that handle 50 fits within a cavity defined by recesses 26 and 32 of body portion 22.

Fork 60 includes a plurality of tines 61, 62, an optional offset portion 64, a slider portion 66, and a tab 68 configured for coupling with inner pivot point 56 of handle 50. Slider portion 66 is configured to fit within channels 28 and 34 of case halves 24, 30, respectively. As depicted in the Figures, the configuration of channels 28, 34 and slider portion 66 prevents the passage of light through lock 20, as well as prevents water, insects and dust from being able to penetrate lock 20 in all possible positions of lock 20. Alternate configurations of slider 66 and channels 28, 34 which similarly prevent passage of light, water, dust, and/or insects are within the scope of the invention, such as an "L" shape for example. Weatherstripping or other similar flexible membranes may also be provided as part of lock 20 in addition to, or as an alternative to, the serpentine configuration depicted in the Figures.

Linkage 70 is configured to be pivotally coupled between tab 54 on handle 50, and mounting point 42 on body portion 22 via pivot connections 72 and 73, respectively. The arrangement of handle 50, linkage 70 and fork 60 creates a four-bar linkage, with movement of handle 50 causing a translation of fork 60 within body portion 22 of lock 20 in a direction opposite the direction of movement of handle 50.

Referring additionally to FIGS. 8-12, low profile lock 20 is used to latch and lock an operable window sash 136*a* with a window frame 136*b*. A tie bar assembly generally includes tie bar 124 with roller assemblies 126 and tie bar guides 128. Link 130 is riveted to end 132 of tie bar 124 with square rivet 134 through square aperture 136. Lip portion 138 engages in one of lateral notches 106, 108, in slide 42 to link tie bar 124 to drive assembly 32. Lock 20 is configured to be coupled with tie bar 124 via fork 60, wherein tines 61, 62 of fork 60 engage a roller 126.

Figure 9:
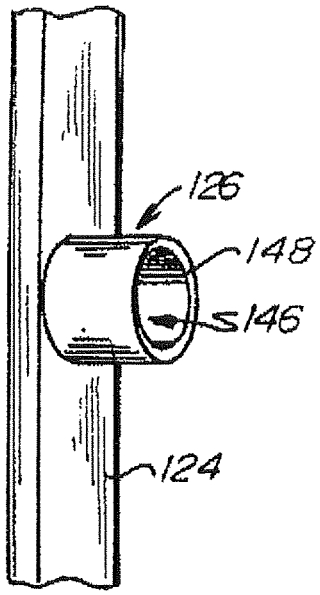
FIG. 9 is a partial perspective view of a roller portion of a roller assembly and a portion of a tie bar of a multi-point sash lock system for a casement window according to an embodiment of the invention.
Figure 10:
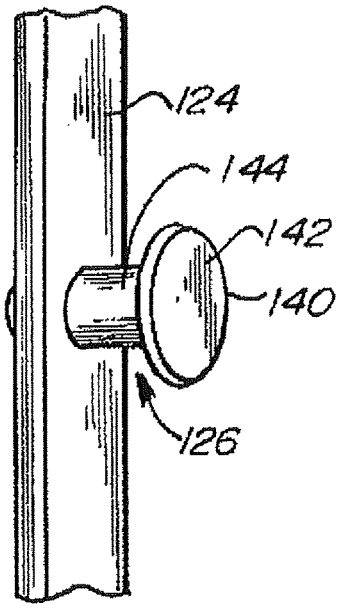
FIG. 10 is a partial perspective view of a rivet portion of a roller assembly and a portion of a tie bar of a multi-point sash lock system for a casement window according to an embodiment of the invention.
Figure 11:
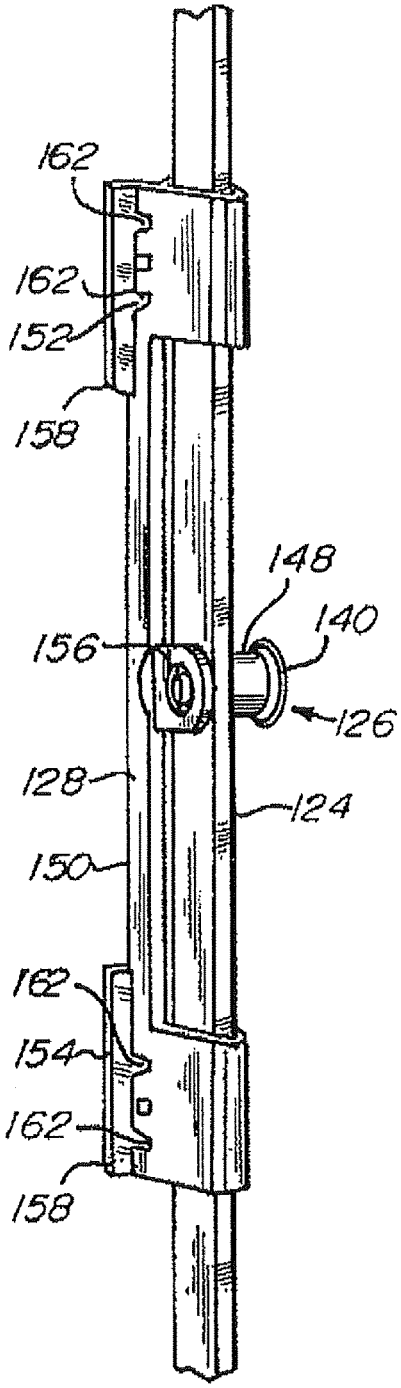
FIG. 11 is a partial perspective view of a tie-bar guide assembly of a multi-point sash lock system for a casement window according to an embodiment of the invention, depicting the tie-bar guide and tie-bar together.
Figure 12:
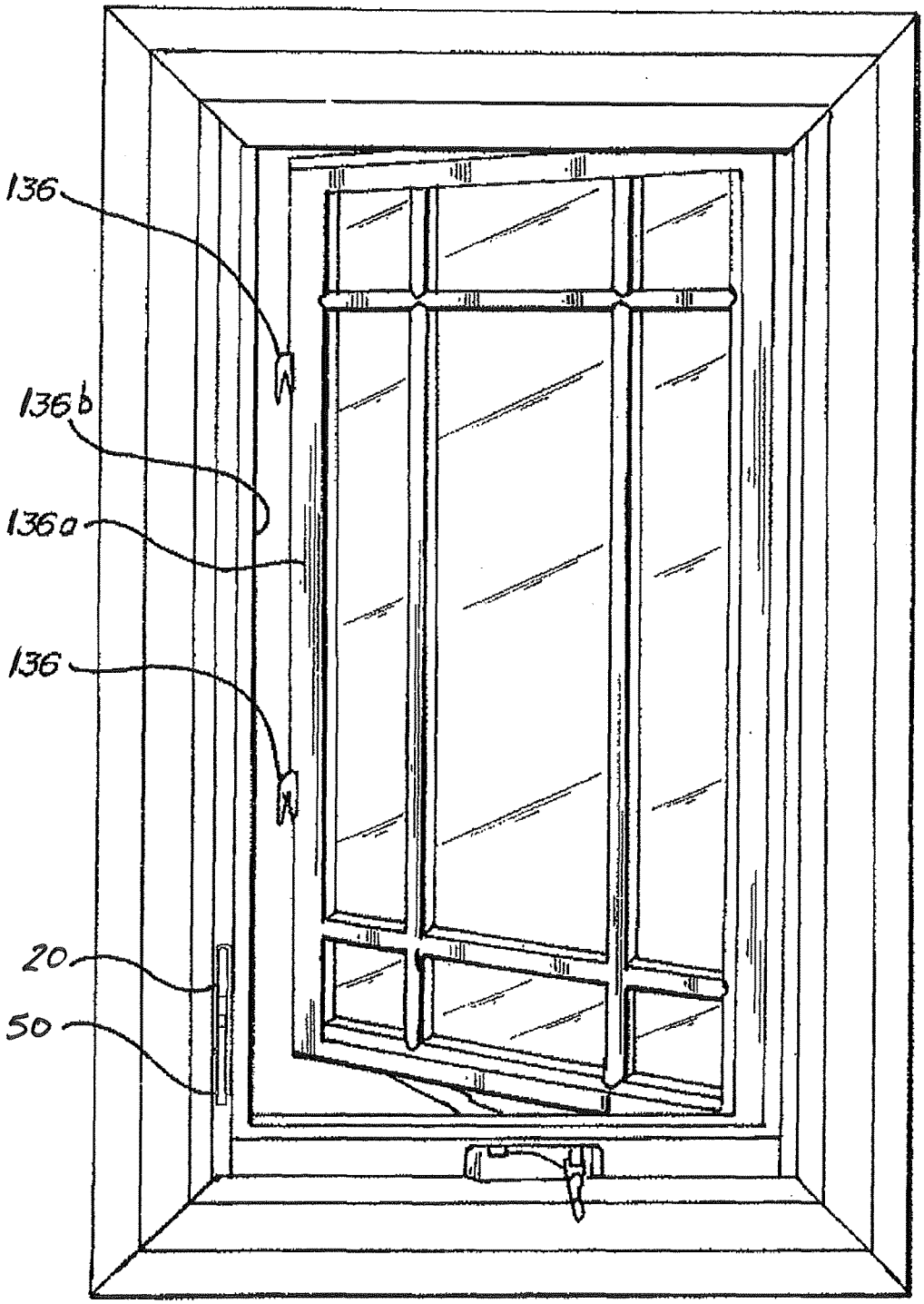
FIG. 12 is a perspective view of a casement window equipped with the low-profile lock of FIG. 1.

Each roller assembly 126 as depicted in FIGS. 9-11 includes a rivet 140 having a head 142 and a shank 144. Shank 144 extends through bore 146 of roller 148 so that roller 148 rotates on shank 144. Although in the depicted embodiment, rivet 140 and bore 146 are axially aligned with roller 148 being symmetrical about the common axis.

As depicted in FIG. 11, tie bar guide 128 generally includes central body portion 150, guide ends 152, 154, and locating tab 156. At least the central body portion 150 and the guide ends 152, 154 are preferably integrally, unitarily formed. Locating tab 156 preferably is formed with a frangible coupling to the tie bar guide 128. Locating lip 158 is provided to engage in a groove in the window frame to locate the tie bar assembly at a predetermined distance from the window sash. One or more apertures 162 may be provided on tie bar guide 128 for receiving fasteners to attach the guide to a window frame.

Keepers 136 are installed in a window sash by first cutting a slot in the sash by suitable means such as a plunge saw. Once the slot is cut, keeper 136 is secured in the slot, for example with fasteners, such that a hook portion of keeper 136 projects outwardly from window sash 136*a* and is positioned so as to align with roller assemblies 126.

Figure 4:
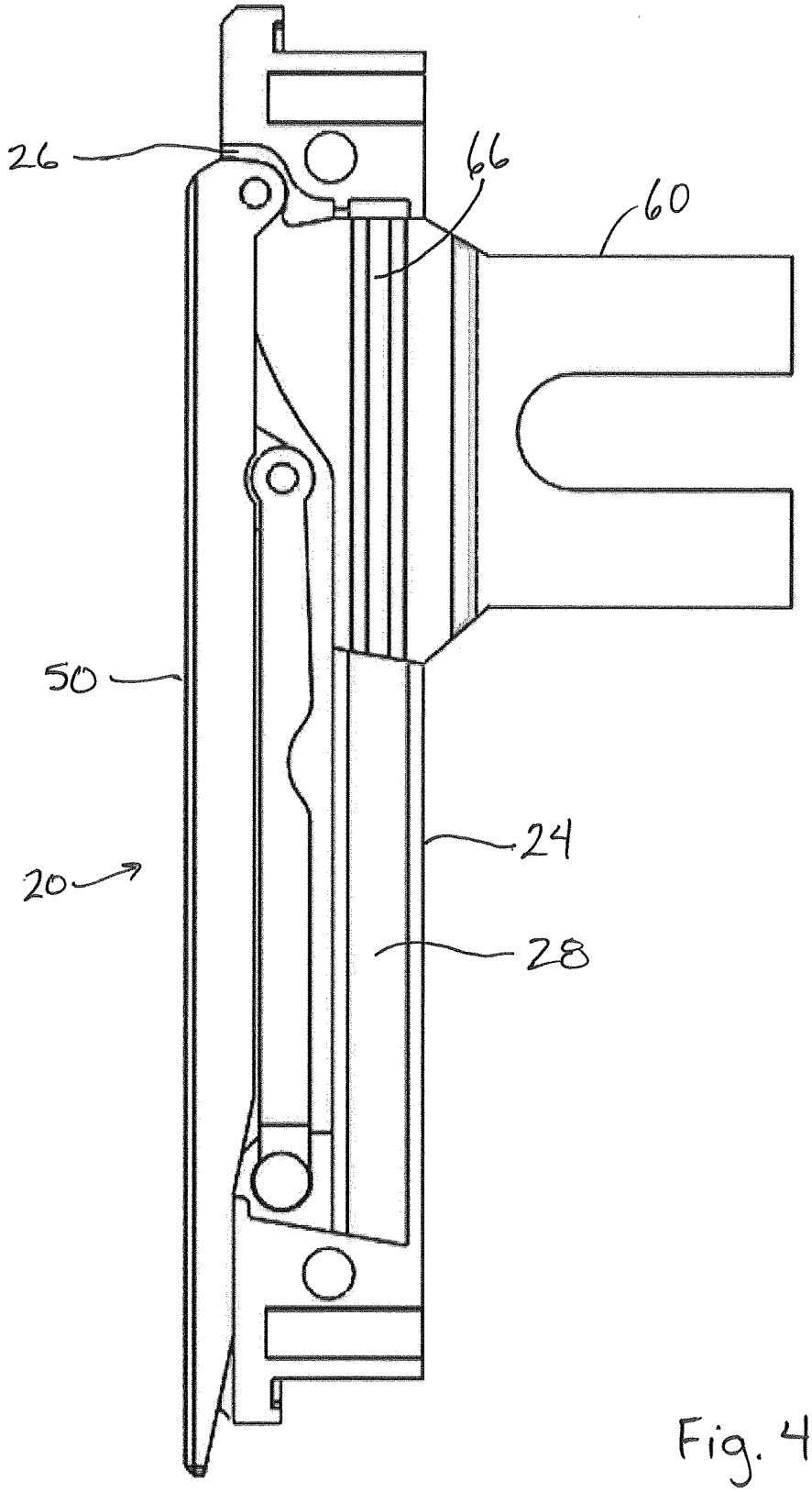
FIG. 4 is a right elevation of the low profile lock of FIG. 1, depicted with the right case half removed and the lock in a closed, locked position.
Figure 5:
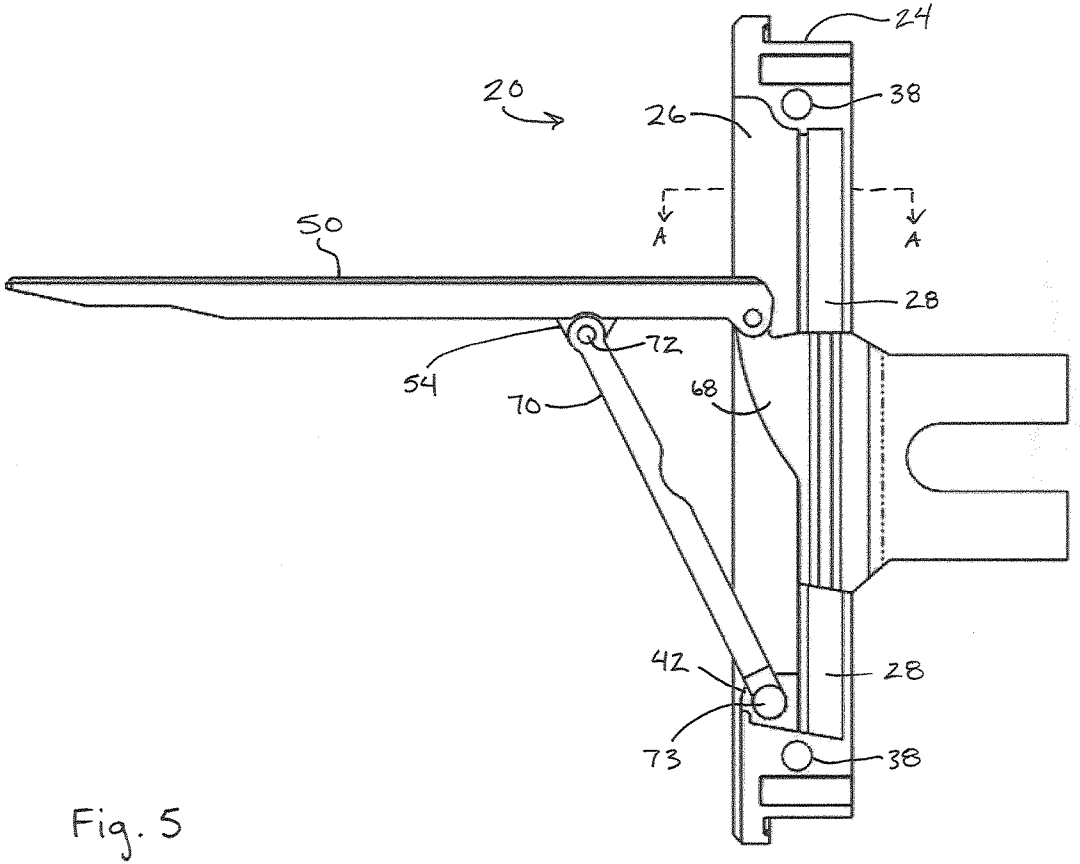
FIG. 5 is a right elevation of the low profile lock of FIG. 1, depicted with the right case half removed and the lock in a mid position between locked and unlocked.
Figure 6:
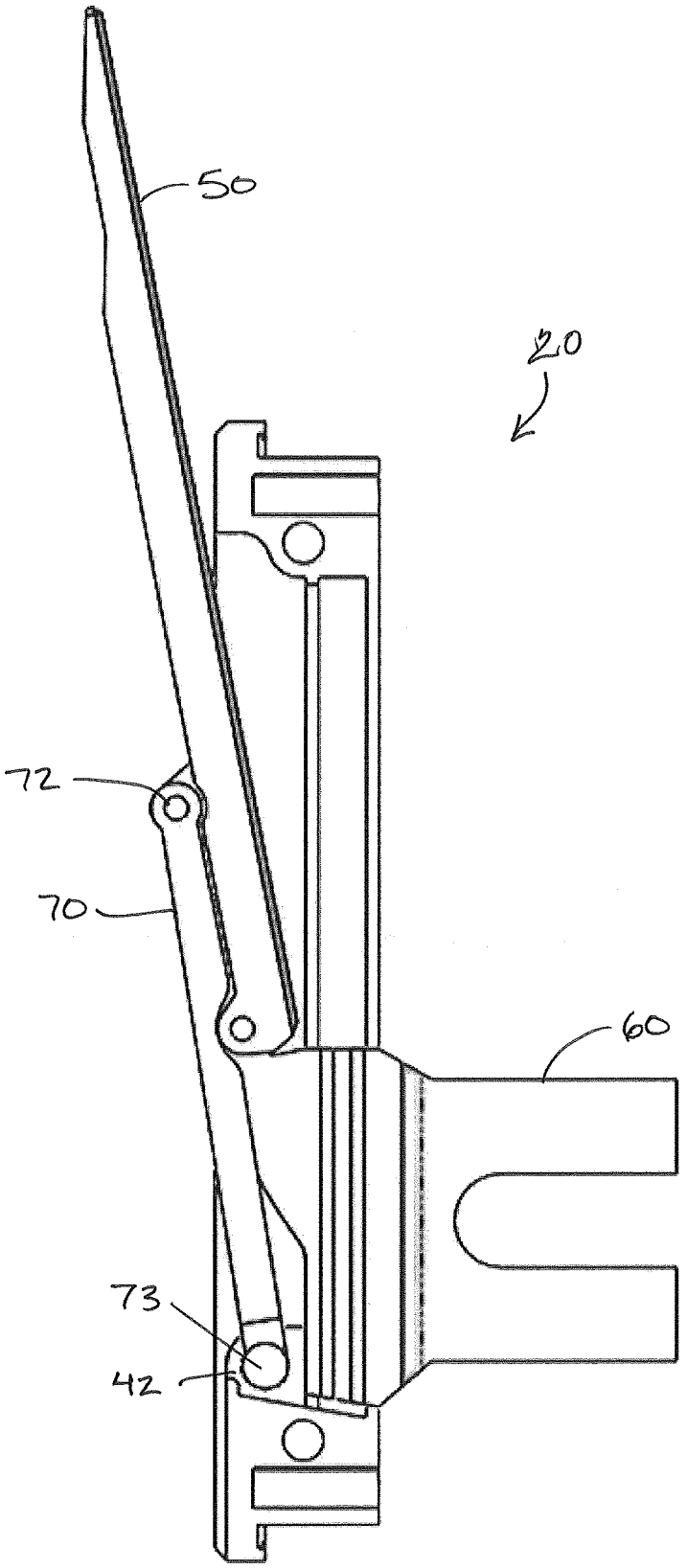
FIG. 6 is a right elevation of the low profile lock of FIG. 1, depicted with the right case half removed and the lock in an open, unlocked position.
Figure 7:
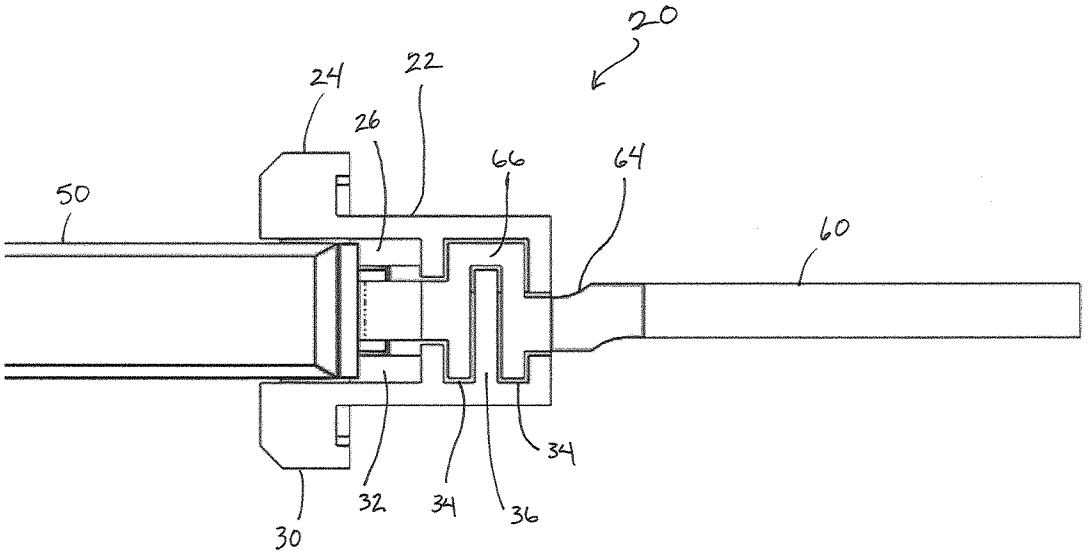
FIG. 7 is a cross-sectional view taken along the line A-A in FIG. 5.
Figure 8:
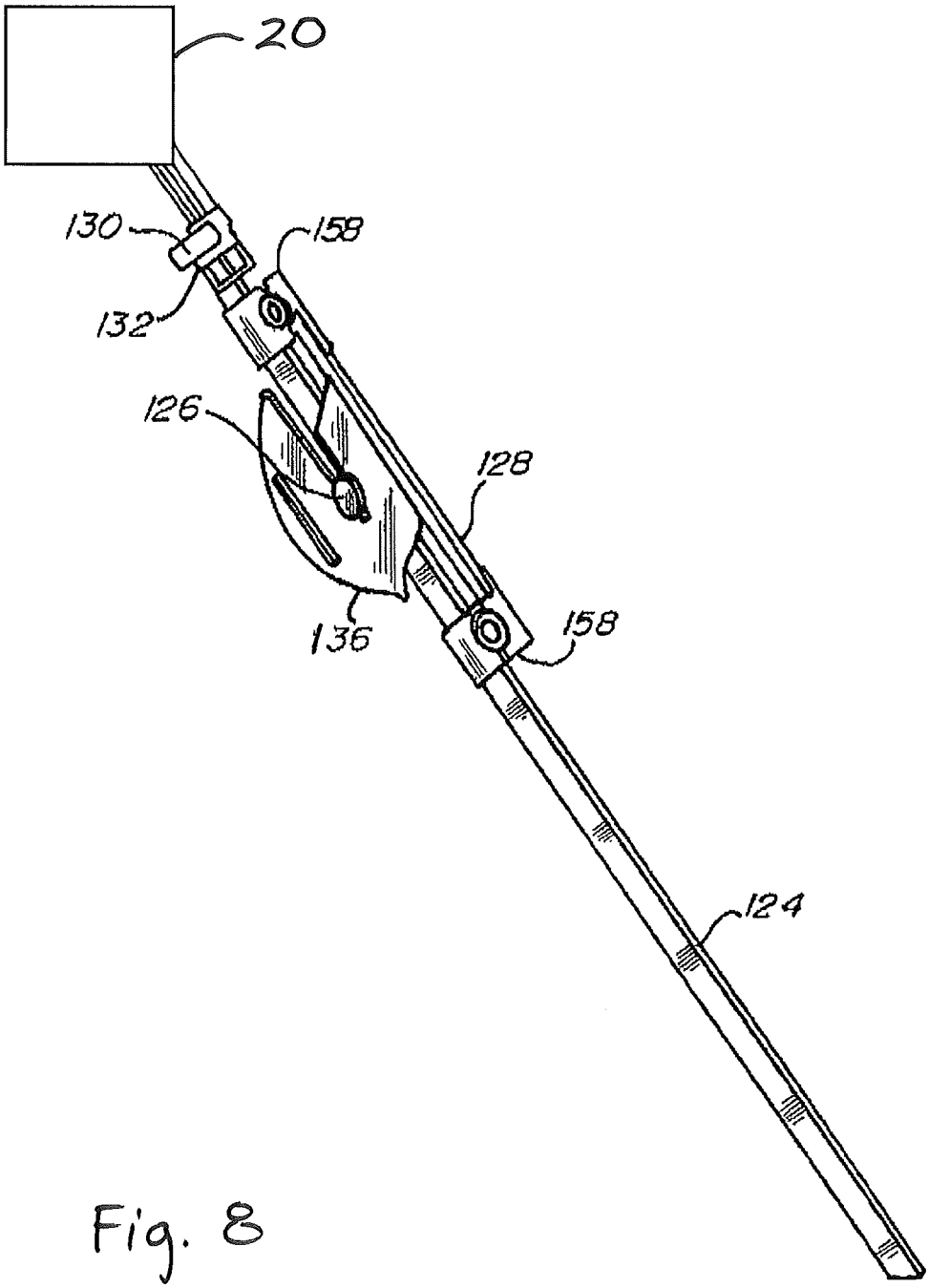
FIG. 8 is a partial perspective view of a multi-point sash lock system for a casement window according to an embodiment of the invention, depicting the lock drive, tie-bar assembly and keeper portions of the system.

In operation, lock 20 is movable between a closed, locked position and an open, unlocked position. To unlock lock 20, beginning in the closed, locked position, grip portion 52 of handle 50 is grasped and handle 50 is pulled upwards toward the open, locked position, as depicted in FIGS. 4-6. Movement of handle 50 causes, via linkage 70, a translation of fork 60 within body portion 22 of lock 20 in a direction opposite the direction of movement of handle 50, with slider portion 66 of fork 60 being movable within channels 28, 34 defined by left case half 24 and right case half 30, respectively. As tines 61, 62 of fork 60 are engaged with a roller 126, movement of fork 60 causes tie bar 124 to slide in tie bar guides 128 and roller assemblies 126 to disengage keepers 136 to release window sash 136*a* from engagement with window frame 136*b* and unlock sash 136*a*. To close lock 20 and secure sash 136 to frame 136*b*, the steps are reversed.

As is apparent from the Figures, in the closed, locked position, handle 50 resides substantially within a cavity formed by recesses 26, 32 so as to create a nearly flush, low profile lock. In one embodiment, handle 50 protrudes approximately 7-10 mm from escutcheon 40. In one embodiment, handle 50 protrudes less than 10 mm from escutcheon 40.

References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of 35 U.S.C. §112(f) are not to be invoked unless the specific terms "means for" or "step for" are recited in the subject claim.

The invention claimed is:

1. A lock for a window, comprising:

a body including a pair of spaced-apart vertically oriented channels defined in an interior of the body, with a protrusion separating the spaced-apart channels;

an actuator element received in the spaced-apart channels and slidable therein, the actuator element including a fork portion configured to operably couple with a tie bar assembly for locking the window;

a handle pivotally coupled to the actuator element; and a linkage pivotally coupled between the body and an intermediate point on the handle, wherein the handle is movable between a closed position and an open position and further wherein movement of the handle causes actuator element to slide within the channel in a direction opposite the direction of movement of the handle.

2. The lock of claim 1, wherein the body further defines a recess therein, and wherein the lock is configured such that at least a portion of the handle is receivable within the recess when the handle is in the closed position so as to present a low profile.

3. A system, comprising:

a lock, including:

an elongated body portion having a length greater than a width, the body portion including a pair of spaced-apart vertically oriented channels defined in an interior of the body, with a protrusion separating the spaced-apart channels;

a fork component slidable in the spaced-apart channels of the elongated body portion;

a linkage pivotally coupled to the body portion; and a handle pivotally coupled at one end to the fork component and pivotally coupled at an intermediate point on the handle to the linkage; and a tie bar assembly, including at least one roller for engaging a keeper of a window sash, wherein the fork component of the lock is operably engaged with the tie bar assembly such that movement of the handle causes a sliding movement of the fork component along a portion of the length of the body portion in a direction opposite the direction of movement of the handle so as to engage or disengage the at least one roller from the keeper.

4. The lock of claim 1, wherein the spaced-apart channels are oriented along a longitudinal axis of the body, and wherein the spaced apart channels and the protrusion define a serpentine path relative to a direction perpendicular to the longitudinal axis.

5. The system of claim 3, wherein the spaced-apart channels are oriented along a longitudinal axis of the body, and wherein the spaced apart channels and the protrusion define a serpentine path relative to a direction perpendicular to the longitudinal axis.

* * * * *